US009870856B2

(12) United States Patent
Krishnamoorthy et al.

(10) Patent No.: US 9,870,856 B2
(45) Date of Patent: Jan. 16, 2018

(54) MAGNETIC COMPONENT ASSEMBLY WITH FILLED PHYSICAL GAP

(71) Applicant: Cooper Technologies Company, Houston, TX (US)

(72) Inventors: Ahila Krishnamoorthy, Danville, CA (US); Robert James Bogert, Lake Worth, FL (US); Yipeng Yan, Shanghai (CN)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 253 days.

(21) Appl. No.: 14/146,989

(22) Filed: Jan. 3, 2014

(65) Prior Publication Data

US 2014/0266539 A1 Sep. 18, 2014

Related U.S. Application Data

(60) Provisional application No. 61/787,950, filed on Mar. 15, 2013.

(51) Int. Cl.

| | |
|---|---|
| ***H01F 27/02*** | (2006.01) |
| ***H01F 27/06*** | (2006.01) |
| ***H01F 17/06*** | (2006.01) |
| ***H01F 27/29*** | (2006.01) |
| ***H01F 5/00*** | (2006.01) |
| ***H01F 17/04*** | (2006.01) |

(Continued)

(52) U.S. Cl.

CPC ..... *H01F 27/292* (2013.01); *H01F 3/10* (2013.01); *H01F 3/14* (2013.01); *H01F 17/04* (2013.01); *H01F 27/255* (2013.01); *H01F 27/2847* (2013.01); *H01F 27/306* (2013.01); *H01F 2003/106* (2013.01); *H01F 2017/048* (2013.01)

(58) Field of Classification Search

CPC ..... H01F 27/027; H01F 27/292; H01F 3/14; H01F 5/04; H01F 5/00; H01F 27/2847; H01F 27/28

USPC ..... 336/65, 83, 178, 192, 200, 221, 232

See application file for complete search history.

(56) References Cited

U.S. PATENT DOCUMENTS 4,696,100 A * 9/1987 Yamamoto ..... H01F 17/045 336/192

4,769,900 A 9/1988 Morinaga (Continued)

FOREIGN PATENT DOCUMENTS

JP 2001052934 A 2/2001

JP 201351399 A 3/2013

(Continued)

OTHER PUBLICATIONS

International Search Report and Written Opinion of International Application No. PCT/US2014/024588; dated Jun. 25, 2014; 16 pages.

(Continued)

*Primary Examiner* — Tsz Chan

(74) *Attorney, Agent, or Firm* — Armstrong Teasdale LLP

(57) ABSTRACT

Magnetic component assemblies for circuit boards include single, shaped magnetic core pieces formed with a physical gap and conductive windings assembled to the cores via the gaps. The physical gaps in the cores are filled with a magnetic material to enhance the magnetic performance. The magnetic component assemblies may define power inductors.

44 Claims, 6 Drawing Sheets

(51) Int. Cl.

| | |
|---|---|
| ***H01F 27/28*** | (2006.01) |
| ***H01F 3/10*** | (2006.01) |
| ***H01F 3/14*** | (2006.01) |
| ***H01F 27/255*** | (2006.01) |
| ***H01F 27/30*** | (2006.01) |

(56) References Cited

U.S. PATENT DOCUMENTS

| | | | | |
|---|---|---|---|---|
| 6,356,179 | B1 | 3/2002 | Yamada | |
| 6,504,463 | B1 * | 1/2003 | Kato | H01F 27/292 336/192 |
| 2002/0067234 | A1 * | 6/2002 | Kung | H01F 17/0006 336/192 |
| 2003/0227366 | A1 | 12/2003 | Lin | |
| 2008/0024255 | A1 * | 1/2008 | Sano | H01F 27/255 335/297 |
| 2008/0055034 | A1 | 3/2008 | Tsunemi et al. | |
| 2008/0231406 | A1 | 9/2008 | Lin et al. | |
| 2008/0309443 | A1 * | 12/2008 | Furuya | H01F 17/045 336/83 |
| 2010/0013587 | A1 | 1/2010 | Yan et al. | |
| 2010/0060398 | A1 * | 3/2010 | Lin | H01F 17/043 336/65 |
| 2010/0148902 | A1 | 6/2010 | Shin et al. | |
| 2010/0253456 | A1 | 10/2010 | Yan | |

FOREIGN PATENT DOCUMENTS

| | | | |
|---|---|---|---|
| JP | 2013051399 A | * | 3/2013 |
| TW | 434594 B | | 5/2001 |

OTHER PUBLICATIONS

SMT Power Inductors—SLC7530 Series; Document 366-1; © Coilcraft, Inc. 2007; 3 pages.

SMT Power Inductors—SLC7649 Series; Document 481-1; © Coilcraft, Inc. 2007; 2 pages.

SMT Power Inductors—SLC1049 Series; Document 498-1; © Coilcraft, Inc. 2007; 2 pages.

* cited by examiner

MAGNETIC COMPONENT ASSEMBLY WITH FILLED PHYSICAL GAP

CROSS REFERENCE TO RELATED APPLICATIONS

This application claims the benefit of U.S. Provisional Application Ser. No. 61/787,950 filed Mar. 15, 2013, the complete disclosure of which is hereby incorporated by reference in its entirety.

BACKGROUND OF THE INVENTION

The field of the invention relates generally to magnetic components for circuit boards and related manufacturing methods, and more specifically to surface mount magnetic components such as power inductors having shaped magnetic cores and conductive windings exposed on the side walls and on the bottom of the magnetic cores.

Power inductors are used in power supply management applications and power management circuitry on circuit boards for powering a host of electronic devices, including but not necessarily limited to hand held electronic devices. Power inductors are designed to induce magnetic fields via current flowing through one or more conductive windings, and store energy via the generation of magnetic fields in magnetic cores associated with the windings. Power inductors also return the stored energy to the associated electrical circuit as the current through the winding falls and may provide regulated power from rapidly switching power supplies.

In order to meet increasing demand for electronic devices, especially hand held devices, each generation of electronic devices needs to be not only smaller, but offer increased functional features and capabilities. As a result, the electronic devices tend to be increasingly powerful devices in smaller and smaller physical packages. Meeting increased power demands of ever more powerful electronic devices while continuing to reduce the size of circuit boards and components such as power inductors that are already quite small, has proven challenging, however.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
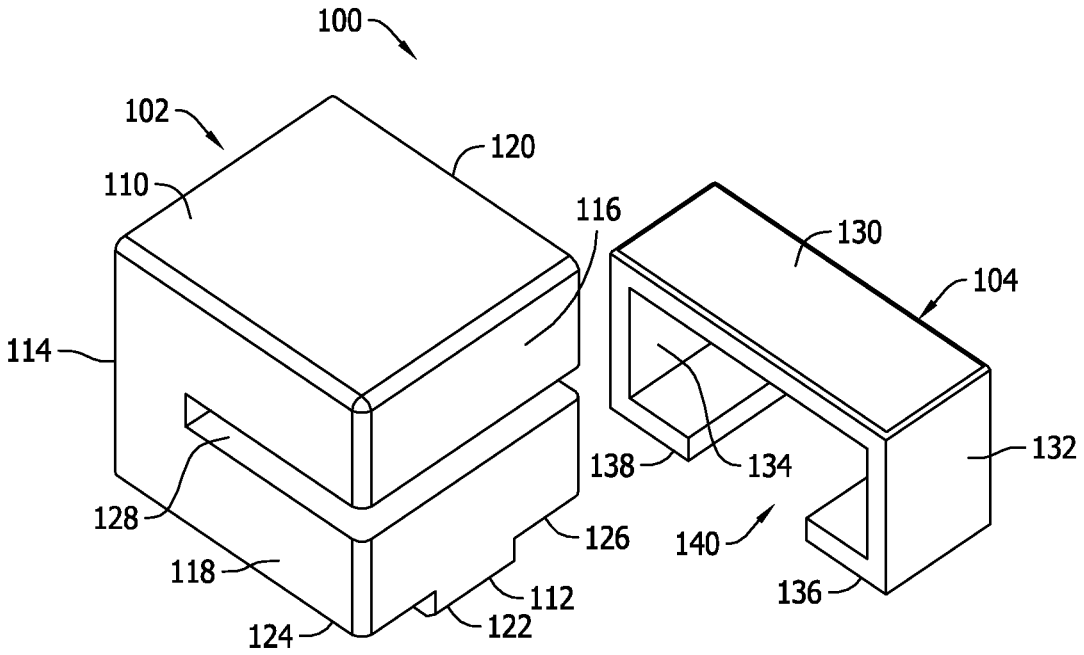
FIG. 1 is an assembly view of a first exemplary embodiment of a surface mount magnetic component at a first stage of manufacture.

In order to provide increasingly powerful electronic devices having an ever expanding number of features and capabilities, the power inductors used in the power management circuitry in general must operate at higher levels of current and power as the devices operate. Known techniques to manufacture miniaturized power inductors for circuit board applications are, however, disadvantaged in some aspects for higher current applications.

Laminated power inductor products are known having a number of magnetic layers or substrates upon which planar portions of a conductive winding may be formed. When the planar winding portions of the various layers are connected with one another, a larger conductive coil is completed amongst the various layers in the device. Forming fine conductive windings on the surfaces of magnetic substrates and the like using printing techniques, deposition techniques, or lithography techniques can successfully provide extremely small components. However, such windings formed by such techniques are limited in their ability to function at high current, high power levels, let alone provide desired performance for certain applications.

In lieu of forming conductive windings on the surfaces of magnetic substrates and the like, shaped magnetic cores are sometimes used in combination with separately fabricated, freestanding conductor elements that are shaped or bent into the final form of a conductive winding as the power inductor is manufactured. In many instances, such freestanding conductor elements are shaped or bent around one or more surfaces of the magnetic core pieces utilized. Specifically, in such embodiments, the conductor is extended through a through-hole formed in the magnetic body, and one or both ends of the conductor is typically bent around opposing side wall edges of the magnetic core to form surface mount terminals for the power inductor to be terminated to corresponding circuit mount pads on a circuit board.

Because the shaped magnetic core pieces are relatively small, however, they are also relatively fragile. Conventional bending or shaping the freestanding conductor around the core piece can be problematic if the magnetic core piece or the conductor is damaged during manufacture of the component. Of course, increasing the cross sectional area of the conductor utilized to fabricate the winding results in a stiffer conductor that is more difficult to bend, and hence only increases the difficulty of manufacturing power inductors without cracking or otherwise damaging the magnetic core pieces. Damage to the core pieces, which may be difficult to control or detect, can lead to considerable performance fluctuation in the manufactured power inductors that is inherently undesirable. Still further, thicker and stiffer conductor elements that are desirable in high current applications present further difficulties in providing completely flat surface mount terminals when bending the conductor around the core. If the surface mount terminals are not flat, the mechanical and electrical connections when the device is mounted to a circuit board is likely to be compromised.

More recently, it has been proposed to use so-called preformed conductive windings that are separately fabricated from magnetic cores and are entirely shaped in advance to include the surface mount terminal pads needed to connect the winding to a circuit board. Such preformed conductive windings may have a C-shaped clip configuration that may be slidingly assembled to magnetic core pieces without bending or shaping any portion of the winding over the magnetic core pieces utilized.

In certain types of devices, monolithic magnetic core pieces are provided from compressed magnetic powder materials via molding techniques, and one or more physical, non-magnetic gaps are provided in the body. Typically, in a molded magnetic powder construction of a shaped core, the non-magnetic gaps are simply air gaps in the core construction. While such air gap constructions are satisfactory for many applications, there are performance limits of such a power inductor construction, and improvements are desired.

In other types of devices, first and second shaped core pieces are assembled about a conductive winding. A filler material, such as glass beads is provided between the first and second shaped cores to physically gap the first and second shaped cores from one another. The glass bead material introduces cost to the component construction, and is sometimes difficult to reliably apply it in a uniform manner to maintain a consistent, desired gap thickness across a large number of components.

In still other components, a single core piece has been proposed to avoid difficulties of gapped first and second core pieces. Such single core pieces are provided with one or more gaps so that energy may be stored in the component. The gaps are typically formed by grinding process using, for example, a diamond saw. Because of dimensional aspects of sawing blade, very thin gaps cannot be made. Finer gap sizes can be accomplished by laser machining or alternative methods, but at greater expense.

A power inductor manufacture is desired to provide surface mount power inductor components that may operate at higher currents with improved magnetic performance. Accordingly, exemplary embodiments of surface mount power inductor components are described below that offer performance improvements. Method aspects will be in part apparent and in part explicitly discussed in the following description in which the benefits and advantages of the inventive concepts will be demonstrated.

FIG. 1 illustrates a first exemplary embodiment of a magnetic component construction 100 at a first stage of manufacture. As seen in FIG. 1, the component 100 includes a single piece, preformed magnetic core 102 and a preformed conductive winding 104. The single piece core 100 is specifically distinguished from a component construction having discrete, first and second shaped core pieces that are assembled to one another in the component fabrication. In other words, the component 100 in the exemplary embodiment shown has one core piece 102 rather than two core pieces as in some types of conventional component constructions.

The magnetic core piece 102 in the example of FIG. 1 includes a generally rectangular body having orthogonal walls including opposing top and bottom side walls 110, 112, opposing lateral side walls 114, 116 interconnecting the top and bottom side walls 110, 112, and opposing longitudinal side walls 118, 120 interconnecting the top and bottom side walls 110, 112 and the lateral side walls 114, 116. The bottom side wall 112 is formed with a projecting guide surface 122 extending longitudinally between the lateral side walls 114, 116 and recessed side wall edges 124, 126 extending on either side wall of the guide surface 122. The remaining side walls 110, 114, 116, 118 and 120 are generally flat and planar in the exemplary embodiment shown.

The magnetic core piece 102 is further formed with a physical gap 128 that extends to and through the lateral side wall 116 and to and through portions of the longitudinal side walls 118, 120. As such, the gap 128 is open at the core side wall 116 and also is open at portions of the core side walls 118, 120. The gap 128 extends generally parallel to the flat and planar top side wall 110, but is spaced from the top side wall 110. In the example shown, the gap 128 extends generally centrally in the core piece 102 and is about equidistant from the top and bottom side walls 110, 112. The gap 128 does not extend, however, to the lateral side wall 114. In other words, the gap 128 extends only partially between the side walls 114 and 116. Rather, the lateral side wall 114 is solid and has no openings formed therein. The gap 128 is also formed with a constant thickness t (FIG. 2) measured in a direction perpendicular to the plane of the top side wall 110 and parallel to the plane of the side walls 114, 116, 118 and 120.

The preformed conductive winding 104 is formed from a conductive material and generally includes a flat and planar main winding section 130, opposing terminal sections 132, 134 extending generally perpendicular to the plane of the main winding section 130, and surface mount terminal sections 136, 138 extending inwardly from the terminal sections 132, 134 in a spaced relation from, but generally parallel to, the main winding section 130. A gap 140 extends between the distal ends of the surface mount terminal sections 136, 138. The thickness of the main winding section 130 is about equal to and slightly less than the thickness t (FIG. 2) of the gap 128 formed in the core piece 102. The winding 104 is fabricated as a separately provided part from the core piece 102 and is provided as a freestanding structure for assembly with the core piece 102 as described below.

Figure 2:
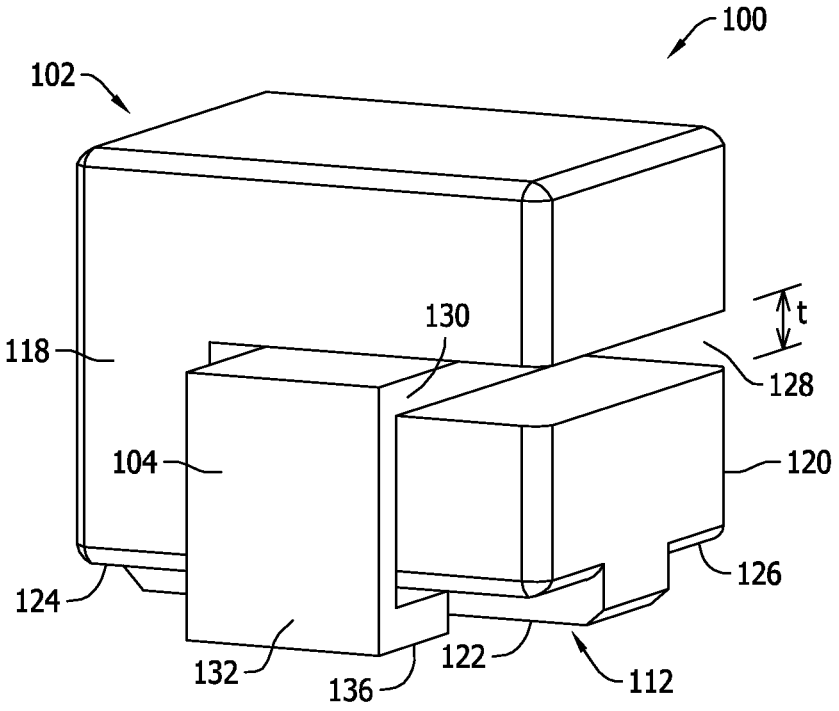
FIG. 2 is a side perspective view of the surface mount magnetic component shown in FIG. 1 at a first stage of manufacture.

As shown in FIG. 2, the preformed conductive winding 104 is assembled to the core 102 by inserting the main winding section 130 of the preformed winding 104 in the core gap 128 with the terminal sections 132, 134 extending alongside the core side walls 118 and 120 and the surface mount terminal sections 136, 138 extending along the recessed side wall sections 124, 126 of the bottom wall 112 on either side wall of the guide surface 122, which in turn is received in the winding gap 140 (FIG. 1). The cross sectional area of the core 102 below the core gap 128 has a T-shape that inter-fits with a complementary interior opening of the preformed winding 104. The winding 104 may therefore be slidingly assembled with the core 102 as shown in FIGS. 1 and 2 until the main winding section 130 reaches the end of the gap 128. Such sliding assembly of a preformed winding 104 to the core 102, which is facilitated by the uniform thickness of the gap 128 formed in the core 102, beneficially avoids more complicated manufacturing steps, and also associated issues discussed above relating to insertion of a conductor through a through-hole and bending the ends of the conductor around the side walls of the core to complete the surface mount terminations.

Figure 3:
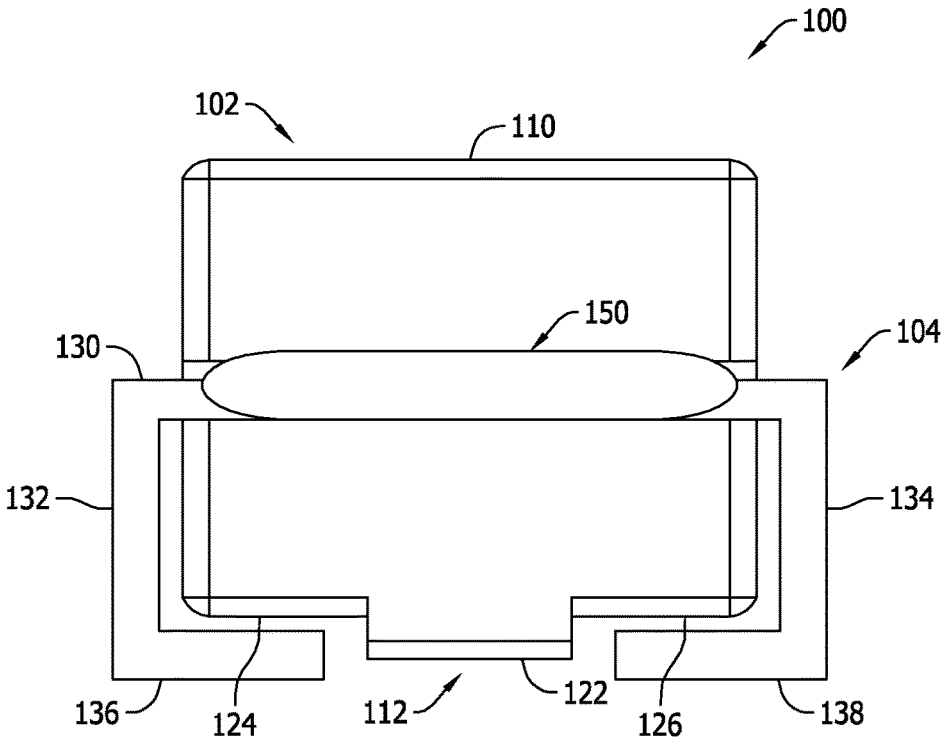
FIG. 3 is an end elevational view of the surface mount magnetic component shown in FIG. 1 at a second stage of manufacture.

As shown in FIG. 3, after assembly of the preformed winding 104, the gap 128 in the core piece 102 is filled with a magnetic material 150 to provide enhanced magnetic performance. When filled with a magnetic material 150, the gap 128, which otherwise would be non-magnetic, becomes a magnetic gap that provides for improved magnetic performance of the device 100.

Filling the gap 128 with magnetic material 150 of a strategically selected magnetic permeability may achieve optimal performance of the component 100. More specifically, the component 100, by virtue of the magnetic material 150, may operate with a reduced fringing loss when operating with a given current level as compared to conventional power inductor constructions where the gap 128 is non-magnetic. The selection of the magnetic material 150 may be further coordinated with the magnetic material used to fabricate the core piece 102.

In one embodiment, the core piece 102 may be fabricated from a ferrite material while the magnetic material 150 is a non-ferrite material. Due to the differences in magnetic properties of ferrite and non-ferrite magnetic materials, fringing losses may be considerably reduced using a combination of materials to fabricate the core piece 102 and to fill the gap 128.

In a further embodiment, ferrite particles may be ground to a fine powder and mixed with polymer to form distributed gap ferrite material that may be shaped into the core 102. A non-ferrite magnetic material, such as iron based alloys or other magnetic material, may be mixed with polymer and formed into a distributed gap material that may be utilized as the magnetic material 150 to fill the gap 128.

In another embodiment, non-ferrite but nonetheless magnetic particles such as iron based alloys or other magnetic material, may be mixed with polymer and formed into a distributed gap material that may be shaped into the core piece 102. Ferrite particles may be ground to a fine powder and mixed with polymer to form distributed gap ferrite material that may be utilized as the magnetic material 150 to fill the gap 128.

In still other embodiments, the magnetic material utilized to form the body 102 and the material 150 utilized to fill the gap 128 may each be ferrite or non-ferrite magnetic materials, so long as the magnetic material utilized to form the body 102 and the material 150 utilized to fill the gap 128 possess different magnetic properties.

In each case, magnetic powder materials are selected in view of the desired performance metrics, including but not necessarily limited to initial magnetic permeability ($\mu_i$), saturation magnetization ($B_{sat}$), and frequency dependence. The selected magnetic materials are mixed with polymers to form a powder-polymer mixture. The composition of this mixture may be chosen for desired inductance and fringing loss performance.

For purposes of the magnetic material 150 to fill the gap 128, this mixture may be provided in either powder or ribbon form and filled/placed in the gap 128 of the core piece 102 that is fabricated from another magnetic material with different properties. For example, a mixture of powder and polymer can be pressed and fired at elevated temperatures (called annealing or consolidation) during which process, the polymer may be burnt off, but the powder particles fuse together to form a solid disc that can be used as a high density insert in the gap 128. Elevated temperatures may be of the order of about 400° C. to about 600° C. in inert atmosphere. Otherwise, the metal particles will oxidize and might become non-magnetic. Such a processes may provide relatively high density discs compared to powder and polymer mixture in which polymer is present in the ribbon in the end. Magnetic powders are metallic in general and have a high density of 6 to 7 g/cc whereas polymer is only 0.7 g/cc. Therefore, a presence of polymer in ribbon renders it have a lower density, but provides a distributed gap. In the formation of high density discs as discussed above, the metal or alloy powder may be coated with silicate based coatings that melt and fuse and form a distributed non-magnetic gap around magnetic particles, but the fusing process results in reduction of air gaps between particles and therefore increases density of the finished material.

With the preformed winding 104 in place as shown in FIG. 2, the gap 128 is filled with the magnetic material 150 and the entire assembly is held in position and annealed at the cure temperature of the polymer utilized. For example epoxy polymer resins are cured at 160° C. whereas an EPDM type of rubber polymer may be cured at 200° C. The curing process seals the gap 128 with the magnetic material 150.

While the example shown in FIGS. 1-3 includes a single gap 128, additional gaps may be provided at other locations in the core 102 and also may be filled with the magnetic material 150 to provide components having enhanced magnetic performance. In particular, dual gaps may be provided on both side walls of the main winding section 130 of the preformed winding 104. Such dual gaps may require the core 102 to be fabricated in two pieces instead of one such that the gap 128 extends entirely across the core 102 from side wall 116 to side wall 114 of the core 102. The second core piece would then overly the main winding section 130 of the preformed winding 1104 and the core piece 102.

Advantages of the gap 128 being filled with the magnetic material 150, as opposed to being a non-magnetic air gap or being otherwise filled with a non-magnetic material, includes the following.

Fringing field loss is reduced for a given gap thickness t by filling the gap 128 with the material 150.

The gap thickness t can be higher for a given fringing field while simplifying manufacturing processes.

The magnetic material 150 makes it easier to form or assemble cores with higher gap sizes.

Electromagnetic interference of the component 100 with neighboring components may be reduced.

Inductance values of the completed component 100 may be varied by varying the magnetic permeability of the magnetic materials utilized, including inductance values that cannot easily be provided in a component having a non-magnetic gap.

Although the magnetic material 150 utilized can be provided in powder form, variations are possible using other forms. For example, the magnetic material 150 filling the gap 128 may be provided in liquid form or solid form in a known ribbon or tape configuration. In liquid or semisolid form, the magnetic material 150 can be applied to the gap 128 via basic potting methods or by injection or transfer molding techniques. In general, the component 100 including the material 150 in the gap is easily manufacturable with high productivity and reduced cost.

To make the magnetic mixture in liquid form, resins that are liquid at room temperature or that are liquid at a desired operating temperature of injection molding operations (preferably below 100° C. in contemplated embodiments) may be utilized, such that the resin only melts and does not crosslink during flow through channels in the injection mold.

Exemplary magnetic materials and polymers for the magnetic material 150 include polycrystalline or amorphous magnetic powders or their combinations for magnetic materials. Particle sizes may vary within a wide range of about 2 μm to about 200 μm in contemplated examples. The shapes of the magnetic particles may also vary in contemplated examples. Spherical shapes, rod shapes, and random shapes, among others, are possible. The magnetic powder materials may include ferrite, iron based alloys, cobalt based alloys, or other magnetic materials familiar to those in the art.

Exemplary polymer for mixing with the magnetic powder materials include thermosetting polymers such as epoxy or novolac, thermoplastic polymers, combinations of thermosetting and thermoplastic materials, and other equivalent materials familiar to those in the art. Polymers may be provided in solid, liquid, and/or semisolid form in various examples.

As those in the art will appreciate, the processing conditions to cure the component 100 will range depending on the particular polymer(s) utilized and their respective complete crosslinking attributes.

Figure 4:
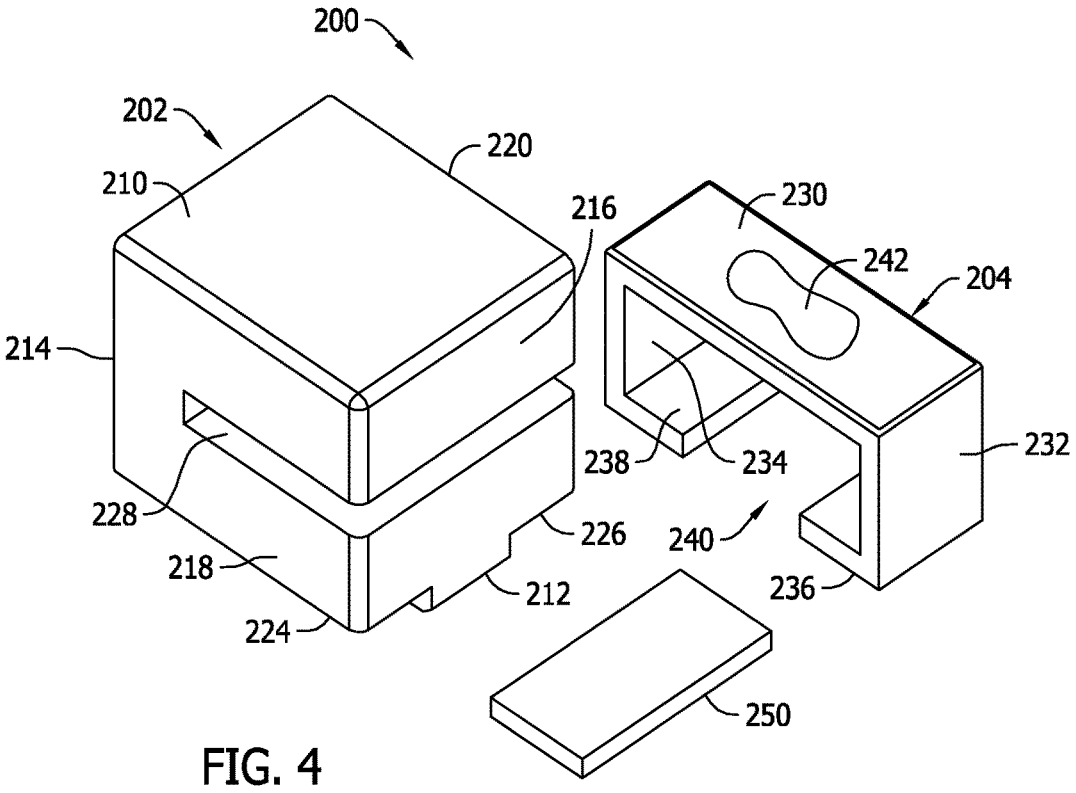
FIG. 4 is an assembly view of a second exemplary embodiment of a surface mount magnetic component.
Figure 5:
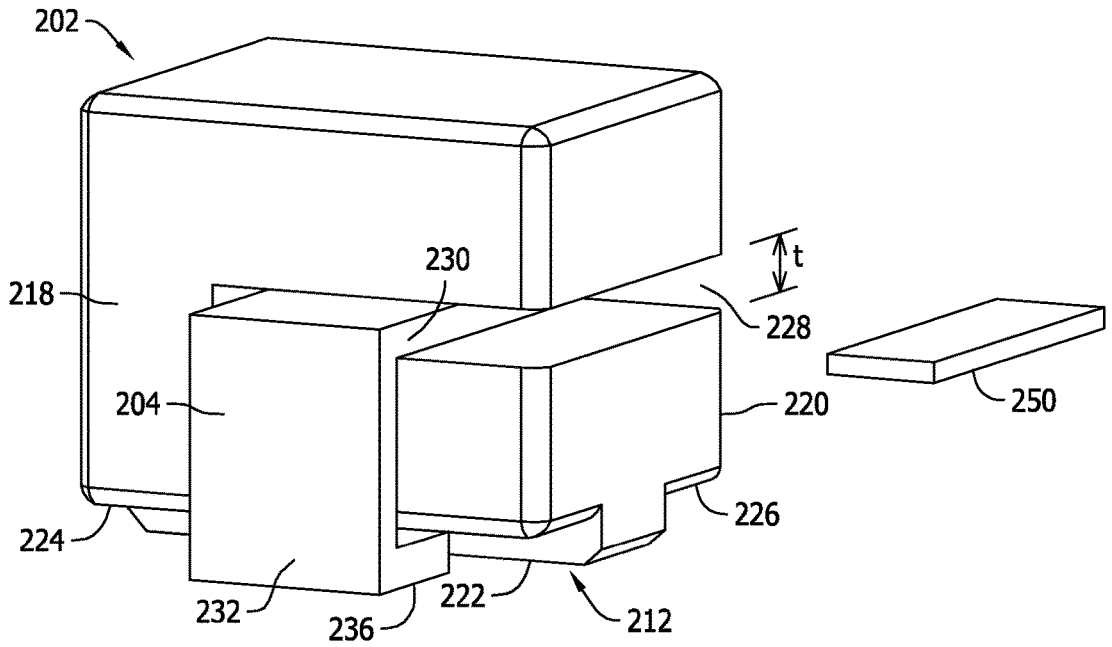
FIG. 5 is a side perspective view of the surface mount magnetic component shown in FIG. 4 at a first stage of manufacture.
Figure 6:
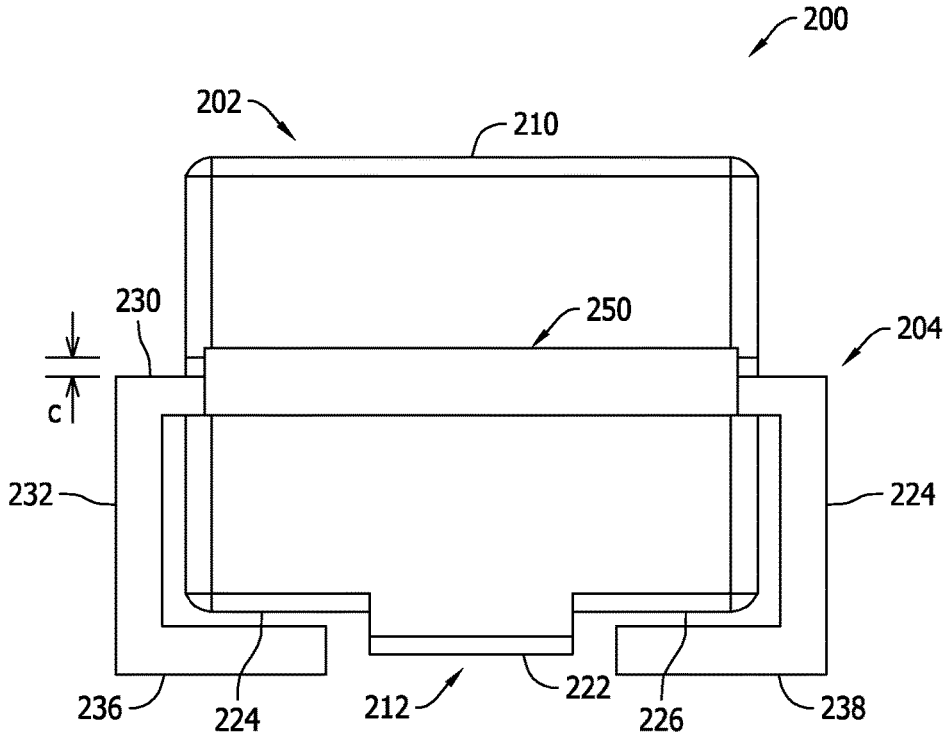
FIG. 6 is an end elevational view of the surface mount magnetic component shown in FIG. 4 at a second stage of manufacture.

FIGS. 4-6 illustrate a second exemplary embodiment of a magnetic component construction 200. As seen in FIG. 4, the component 200 includes a single piece, preformed magnetic core 202 and a conductive winding 204. The single piece core 202 is specifically distinguished from a component construction having discrete, first and second shaped core pieces that are assembled to one another in the component fabrication. In other words, the component 200 has one core piece 202 rather than two core pieces as in some types of conventional component constructions. The component 200 also includes a magnetic material 250, separately provided from the core piece 202, that enhances magnetic performance as explained below.

The shaped magnetic core piece 202 in the example of FIG. 4 includes a generally rectangular body having orthogonal walls including opposing top and bottom side walls 210, 212, opposing lateral side walls 214, 216 interconnecting the top and bottom side walls 210, 212, and opposing longitudinal side walls 218, 220 interconnecting the top and bottom side walls 210, 212 and the lateral side walls 214, 216. The bottom side wall 212 is formed with a projecting guide surface 222 extending longitudinally between the lateral side walls 214, 216 and recessed side wall edges 224, 226 extending on either side wall of the guide surface 222. The remaining side walls 210, 214, 216, 218 and 220 are generally flat and planar in the exemplary embodiment shown. In certain embodiments, however, the projecting guide surface 222 and the recessed side wall edges 224, 226 on the bottom side wall 212 may be considered optional and may be omitted in favor of a flat bottom side wall or a bottom side wall having a different contour.

The magnetic core piece 202 is further formed with a physical gap 228 that extends to and through the lateral side wall 216 and to and through portions of the longitudinal side walls 218, 220. As such, the gap 228 is open at the core side wall 216 and also is open at portions of the core side walls 218, 220. The gap 228 extends generally parallel to the flat and planar top side wall 210, but is spaced from the top side wall 210. In the example shown, the gap 228 extends generally centrally in the core piece 202 and is about equidistant from the top and bottom side walls 210, 212. The gap 228 does not extend, however, to the lateral side wall 214. In other words, the gap 228 extends only partially between the side walls 214 and 216. Rather, the lateral side wall 214 is solid and has no openings formed therein. The gap 228 is also formed with a constant thickness t (FIG. 5) measured in a direction perpendicular to the plane of the top side wall 210 and parallel to the plane of the side walls 214, 216, 218 and 220. While a single (i.e., one and only one) gap 228 is shown, two or more gaps may be formed in the core piece if desired.

In an exemplary embodiment, the core piece 202 is formed and fabricated as follows. Different oxides may be mixed together and molded into the shape as shown. The mold is made to define an initial gap 228 of a fixed size in the core piece 202. After molding the oxide mixture material to the desired shape of the core piece, the material is fired at a high temperature, such as 1500° C. The oxides interdiffuse and form ferrite in the shape of the core piece 202.

It is recognized that the gap size 228 is reduced from its initial size before the core piece 202 is fired to a final size after the firing process to complete the core piece 202. The mold design to shape the core piece 202 should therefore take this into account so that a proper final, as opposed to initial, gap size is obtained. The final molded ferrite core piece 202 can therefore consistently be produced with the desired gap thickness t (FIG. 5). The gap 228 is formed integrally with the core piece 202, as opposed to being formed after the core piece is fabricated using grinding process, laser machining or other techniques.

The conductive winding 204 is formed from a conductive material and generally includes a flat and planar main winding section 230, opposing terminal sections 232, 234 extending generally perpendicular to the plane of the main winding section 230, and surface mount terminal sections 236, 238 extending inwardly from the terminal sections 232, 234 in a spaced relation from, but generally parallel to, the main winding section 230. A gap 240 extends between the distal ends of the surface mount terminal sections 236, 238. The thickness of the main winding section 230 is less than the thickness t (FIG. 5) of the gap 228 formed in the core piece 202.

In contemplated embodiments, the winding 204 may be fabricated from copper that is plated with nickel and tin to make the terminations 236, 238 solderable to a circuit board. Other materials and alloys are possible, however, and may be used to make the winding 204.

Also, in contemplated embodiments, the winding 204 is fabricated as a separately provided part from the core piece 202 and is provided as a freestanding structure in the shape as shown and described for assembly with the core piece 202 as described below. Because it is preformed, the winding 104, sometimes referred to as a clip, can be inserted through the gap 228 in its pre-existing shape. The main winding section 228 slides in easily through the gap 228 and the surface mount terminations rest at the bottom side wall 212 of core. That is, and as shown in FIG. 5, the conductive winding 204 is assembled to the core piece 202 by inserting the main winding section 230 of the preformed winding 204 in the core gap 228 with the terminal sections 232, 234 extending alongside wall the core side walls 218 and 220 and the surface mount terminal sections 236, 238 extending along the recessed side wall sections 224, 226 of the bottom wall 212 on either side wall of the guide surface 222, which in turn is received in the winding gap 140 (FIG. 4). Because the winding 204 is pre-formed and pre-shaped, it need not be bent or shaped into its final form after its assembly with the core piece 202.

In the exemplary embodiment shown, the cross sectional area of the core piece 202 below the core gap 228 has a T-shape that inter-fits with a complementary interior opening of the preformed winding 204. When the winding 204 is preformed, it may be slidingly assembled with the core piece 202 as shown in FIGS. 4 and 5 until the main winding section 230 reaches the end of the gap 228. Such sliding assembly of a preformed winding 204 to the core piece 202, which is facilitated by the uniform thickness of the gap 228 formed in the core piece 202, beneficially avoids more complicated manufacturing steps and also associated issues discussed above such as cracking of the core piece when inserting a conductor through a through-hole and bending the ends of the conductor around the side walls of the core to complete the surface mount terminations as has been done in some conventional types of component constructions.

While a preformed winding clip 204 is believed to be advantageous for the reasons stated, the winding 204 in other embodiments may alternatively be bent and shaped about the core piece 202 after assembly therewith. In this scenario, the winding 204 can initially be provided be provided as a long thin strip of conductive material such as copper plated with nickel and tin in one example. The long thin strip of conductive material has an axial length greater than the corresponding dimension of the gap 228 through which it is inserted, such that the opposing ends of the long thin strip of conductive material project from the gap 228 on each side wall 218, 220 of the core piece 202. The projecting ends of the long thin strip can be bent around the core piece 202 to form the sections 232, 234, 236 and 238 extending around the external surfaces of the core piece 202 as shown in FIG. 5. Of course, care should be taken in bending the ends of the strip to avoid cracking the core piece in doing so.

As best seen in FIG. 6, because the thickness of the main winding section 228 is less than the thickness t of the gap 228, a small space or clearance c is provided between the upper surface of the main winding section 230 and the overlying surface of the core piece 202. This space or clearance c needs to be filled so the winding clip 204 attaches to the core piece 202 and does not vibrate or move during operation.

Accordingly, and as best seen in FIG. 4, bonding agent 242, such as epoxy, is dispensed on the upper surface of the winding 204, and specifically on the surface of the main winding section 230, thereof, before insertion of the winding 204 in the gap 228. The bonding agent 242 anchors the winding 204 in place facilitates the application of the magnetic material 250 as described further below.

In contemplated embodiments, the bonding agent may be an epoxy polymer bonding agent that can be dispensed on the winding 204 and/or in the gap 228 of the core piece 202 either manually or automatically. As one example, a dispensable slurry type epoxy may be utilized such as EB350-4T low expansion adhesive from the Epoxyset Company (www.epoxyset.com). The EB30-4T material may be dispensed in one or more drops on the winding 204 at the center of the main winding section 230 as shown at 242, and if necessary on either side of the center of the main winding section 230 using an automatic or manual dispenser. A small drop of EB350-4T may also be dispensed in gap at the bottom/end of the gap 228 nearest the side wall 214 using a flat dispensing tip. After the adhesive is dispended, the winding 204 may be assembled by inserting the main winding section 230 through the gap 228 and sliding it to the bottom/end of the gap 228 as shown in FIG. 5. As this winding 204 is assembled to the gap 228, the dispensed epoxy is spread around the main winding section 230. Once cured, the adhesive bonding agent 242 attaches and anchors the winding 204 to the core piece 202 and seals the space or clearance c between the main winding section 230 and the overlying portion of the core piece 202.

While an exemplary bonding agent has been identified, other bonding agent materials are possible and may likewise be utilized for similar purposes. The bonding agent 242 dispensed should be carefully controlled such that excess bonding agent does not ooze out of the gap 228 as the winding 204 is assembled to the core piece 202. In other words, the amount of bonding agent 242 dispensed should be sufficient to fill the space or clearance c between the main winding section 230 and the overlying portion of the core piece 202 to hold and secure the clip in place and eliminate possible movement and vibration in use, without any leakage of the bonding agent 242 outside the gap.

In certain contemplated embodiments, the bonding agent may alternatively be a powder polymer that is packed inside the gap 228 in the core piece 202 before inserting the winding 204. The powder polymer bonding agent should preferably melt at process temperature to bond the winding 204 to the core piece 202. Powdery Novolac material such as Plenco 14043 material from Plastic Engineering Co. (www.plenco.com) is one suitable example that melts at about 70° C. and bonds and crosslinks at about 160° C. Others powder polymer agents are possible, however, in other embodiments.

To provide still further performance enhancement, the bonding agent may be mixed with magnetic powder and dispensed as described above on the winding 204 and/or in the gap 228 of the core piece 202. Mixing the bonding agent with magnetic powder materials provides increased inductance values for the component 200.

While epoxy bonding agents are discussed above, non-epoxy materials material likewise be utilized as long as the bonding agent/material can be dispensed, and so long as sufficient bonds between the winding 204, the magnetic strip 250 and the core piece 202 are established when the manufacturing processes are completed. Neat resin (100%), for example, may be advisable as the shrinkage of polymer is less than 1-2% upon curing. Therefore, the curing process does not leave an air gap inside the core 202. In general, the lower the shrinkage rater of the bonding agent utilized, the better it is for sealing of the gap 228 in the core piece 202. Mixing resin with a solvent may perhaps improve dispensability of the bonding agent, but may undesirably introduce gaps in the assembly when cured and as such the use of solvent should be carefully administered.

As shown in FIG. 6, after assembly of the winding 204 to the core piece 202, the remainder of the gap 228 in the core piece 202 is filled with the magnetic material 250 to provide enhanced magnetic performance. When filled with a magnetic material 250, the gap 228, which otherwise would be non-magnetic, becomes a magnetic gap that provides for improved magnetic performance of the device 200. Further increases in inductance values for the component 200 are therefore possible.

As shown, the magnetic material 250 is a solid, thin magnetic strip that is pre-cut to the dimension of the gap 228 in the core piece 202. The thin magnetic strip 250 is inserted into the gap 228. The bonding agent 242 provided on the winding 204 and in the gap 228 rises above, in between the core 202 (i.e., the side faces of the gap 228) and both opposing major surfaces of the strip 250 by capillary action and bonds the sheet 250 to the core piece 202 when cured. The amount of bonding agent dispensed may be adjusted such that the rising of the bonding agent via capillary action is sufficient to coat the major surfaces of the strip 250.

Alternatively, bonding agent dispensed above the winding 204 could also flow downward and fill any left-over space before or behind the winding 204 in the gap 228, but this is a more difficult proposition than rising of the bonding agent by capillary action.

In contemplated embodiments, the magnetic material used to fabricate the strip 250 has a $B_{sat}$ value that is higher than that of ferrite used to fabricate the core piece 202, resulting in equivalent or better saturation performance of gapped ferrite inductors. More specifically, magnetic materials used to fabricate the strip 250 are in general metallic or alloy powders based on iron and are ferromagnetic. Permanent magnet materials based on ferrites (oxide based) may likewise be utilized. The metallic magnetic materials are coated with insulating coating so when current passes through winding 204 it does not leak through the magnetic material strip 250. Ferrites in general are highly electrically resistant and therefore they do not need insulating coating. Examples of alloy magnetic materials are Fe powder, Fe—Si alloy powder or Fe-4.5Cr-3.5Si powder, etc. The alloy powders can be amorphous or polycrystalline or combinations thereof. The powder particles can be round, rod, flakes, or in any shapes. The powders can be of any permeability. Ferrite powders may be obtained by grinding ferrite cores. Exemplary ferrites are Fe—Mn—Zn or Fe—Ni—Zn oxides.

Regardless of the particular magnetic materials utilized, they are made into strip form by mixing the magnetic powders with polymers. The resulting mixture is sometimes referred to as a distributed gap material wherein the non-magnetic polymer forms gaps between magnetic particles or grains. The magnetic material is mixed with polymer in proportions required to accomplish desired inductance and saturation ratings of the component 200.

Exemplary polymers for the magnetic strip 250 include, for example, a rubbery material such as EPDM (ethylene propylene diene monomer), LDPE or HDPE (low or high density polyethylene). Such rubber material, when mixed with magnetic material, makes it easier to form the material into larger sheets, from which a number of strips 250 can therefore be singulated. Alternatively, the magnetic material may be mixed with a Novolac or epoxy or any polymer powder (or liquid resin) and made into sheets through different processes. As one example, a powder mix for compression includes iron alloy powder and Novolac polymer (or epoxy polymer). The powders may be mixed with methanol and dried to make them compressible.

If rubbery materials are mixed with magnetic material, it is relatively easy to form sheets by milling the powder mixture between the two rollers of a two-roll mill (calendering process). For example, polycrystalline or amorphous iron-alloy powder or ferrite powder may be mixed with EPDM rubber in a sheer-type mixer (Brabender). The powder mix is then fed through calendering machine (two roll mill) to fabricate sheets. The distance between rollers is adjusted to produce the proper thickness of sheet material to be inserted into the gap 228. Sheets are provided in the thickness range to facilitate the insertion of the strip 250 in the gap 228. For example, if the gap 228 has a thickness of about 0.8 mm, then the sheet material can be up to about 0.7 mm thick. Various different thicknesses of gaps and magnetic material sheet are possible to provide various performance attributes of the component 200 when completed. The sheets can be cured, for example at about 150° C. for about 30 minutes.

Magnetic strips 150 may be cut from the larger calendered sheets (using a punch and die in one example) and inserted into gap 228 on top of the dispensed epoxy as discussed above. The epoxy rises up the sides of the strip 250 and holds the strip 250 in position relative to the core piece 202 and the gap 228. The magnetic strips 250 may be prefabricated and provided for assembly with the cores 202 and the windings 204 when manufacturing the components 200. The prefabrication of the strip 204 allows insertion of the magnetic material in solid form and in the predetermined shape and dimension to facilitate filling of the gap 228 with relative ease.

High loading of magnetic powder into polymer makes the powders difficult to be calendered (two-roll milled to sheets) to form the sheets. It is possible, however, to provide components 200 having open circuit inductance (OCL) values from about 12 to about 170 nH using magnetic strips 250 fabricated from two-roll milled sheets.

Magnetic and polymer powders if in powder form or if the polymer is in liquid form can also be compressed into discs of a size desired using, for example, compression molding. The discs formed have a thickness that is commensurate with the thickness t of the gap 228 to be filled. Strips 250 can be punched from the disk to the desired length and width and provided as prefabricated parts for assembly with the cores 202 and the windings 204 when manufacturing the components 200. Strips 250 cut from compressed sheets are able to facilitate components having even higher OCL values than the two-rolled milled sheets discussed above. Compressed sheets will also have a higher density (e.g., instead of 4.5 it can be 5.1 g/cc) and higher magnetic permeability (e.g., instead of 5, it can be 25) relative to calendered sheets as described above. By filling the gap 228 in the core piece 202 with such a higher permeability, higher density material, an even higher OCL value can be obtained. For example, OCL values of about 200 nH and greater can be obtained using magnetic strips 250 cut from compressed discs described above.

Once the magnetic strip 250 is formed from sheet material and assembled with the core piece 202 and the winding 204, it functions as a distributed gap material in the gap 228 and helps to smoothen the roll off of inductance as function of DC current. DC bias characteristics of the component 200 are therefore improved.

After the magnetic strip 250 is inserted as described, the whole assembly is placed in an oven. Depending upon the bonding agents or bonding materials utilized curing or crosslinking temperature and time are chosen. For EB350-4T adhesive, curing of the assembly may be accomplished at 150° C. heating for about 1 hour. In this example, this completely crosslinks the resin and firmly attaches the winding 204 and the magnetic strip 250 to the core piece 202. The crosslinking of the resin also seals most of the free space or clearance c (if not all the free space or clearance c) between the winding 204 and the core piece 202. The crosslinking of the resin also seals most, if not all, of any space or area between the magnetic strip 250 and the core piece 202, and between the magnetic strip 250 and the winding 204. The magnetic sheet 250 cannot be removed from the core piece 202 after the curing process is complete.

In lieu of sheet material strips as discussed above, a magnetic material mixture in powder form can alternatively be packed into the gap 228 by compaction techniques such as compression molding, or lamination. This is in-situ pressing of powders into the gap 228 directly, as compared to the indirect application of the material by first forming into a magnetic sheet strip and subsequently applying it to the gap 228. The distributed gap material can be directly squeezed, for example, by injection molding method into the gap 228 and cured. In order to use injection molding of this type, the magnetic powder loading in polymer should be low or else the material mix will not flow through injection mold channels and sprues. The mold and method can be designed in such a way that the channels are not too long, or the mold can have just one part (not a multi-part mold that requires feeding of mixture through channels) so it is easy to push the magnetic material through to the mold cavity.

As yet another alternative to the magnetic strip 250 formed from sheet material, an extrusion process can also be used for packing distributed gap material in the gap 228 in the ferrite core piece 202.

As still another alternative to the magnetic strip 250 formed from sheet material, distributed gap material may be applied to the gap 228 in liquid or slurry form (by using liquid resin and solvents). Such distributed gap material can be filled in the gap 228 using, for example, a syringe. If this is done, curing should follow immediately after this, or else the distributed gap material will flow out of the gap to outside and contaminate the external leads of clips.

In further and/or alternative embodiments, the core piece 202 may include more than one gap, more than winding and/or more than one application of magnetic material to fill the gap(s). In a multiple gap core embodiment, more than one type of magnetic material application to fill the gaps could be used. For example, a magnetic sheet material could be used to fill one gap, and injection molding may be utilized to fill another gap. As another example, magnetic strips with different formulations and having different magnetic properties could be utilized in combination in the same core. Other variations are, of course, possible.

The component 200 desirably provides at least the following benefits.

Because the core 202 includes a single core piece (as opposed to two core pieces, and also because in the embodiments shown the core 202 includes a single gap (as opposed to multiple gaps), the manufacture of the core is simplified and cost savings are realized. The component 200 is therefore manufacturable at lower cost and with a reduced number of parts and materials than many conventional magnetic components for similar purposes.

The thickness of the core gap 228 is built-in to the core piece design, eliminating the difficulties of effecting a gap thickness with an external material such as glass beads and the like. By defining the core gap 228 in the molding used to fabricate the core piece 202, consistent gap thickness is reliably and uniformly provided across a large number of components manufactured in a batch process. External materials such as relatively expensive glass bead materials to define gaps, as well as difficulties associated with maintaining uniform gap thickness when using external materials, is eliminated.

By integrally defining the gap 228 in the core piece 202 as it is molded, smaller gaps are possible that are not possible in conventionally formed gaps using grinding processes with a diamond saw, for example. Finer gap sizes can be also be accomplished without incurring comparatively greater expense of laser machining or alternative methods, but at greater expense. The ability to provide smaller gap sizes, it turn, presents opportunities to manufacture smaller components.

When prefabricated magnetic sheet strip materials are utilized to fill the gaps in the cores, the manufacture of components 200 is simplified and highly reliable.

When preformed windings are utilized, the manufacture of components 200 is further simplified and even more reliable.

From a performance perspective, and by virtue of the magnetic material 250 filling the gap, the component 200 is operable with reduced fringing loss, and hence is operable at higher efficiency than conventional components. Also, inductance of the component 200 may be increased beyond conventional components, including but not limited to conventional components having two gaps. Increased OCL values are possible that are difficult to achieve using conventional component fabrications.

FIGS. 7-12 illustrate a third exemplary second exemplary embodiment of a magnetic component construction 300. The component 300 is similar in some aspect to the component 200, and like reference characters are accordingly utilized with like reference characters in FIGS. 4-6 and 7-12.

Figure 7:
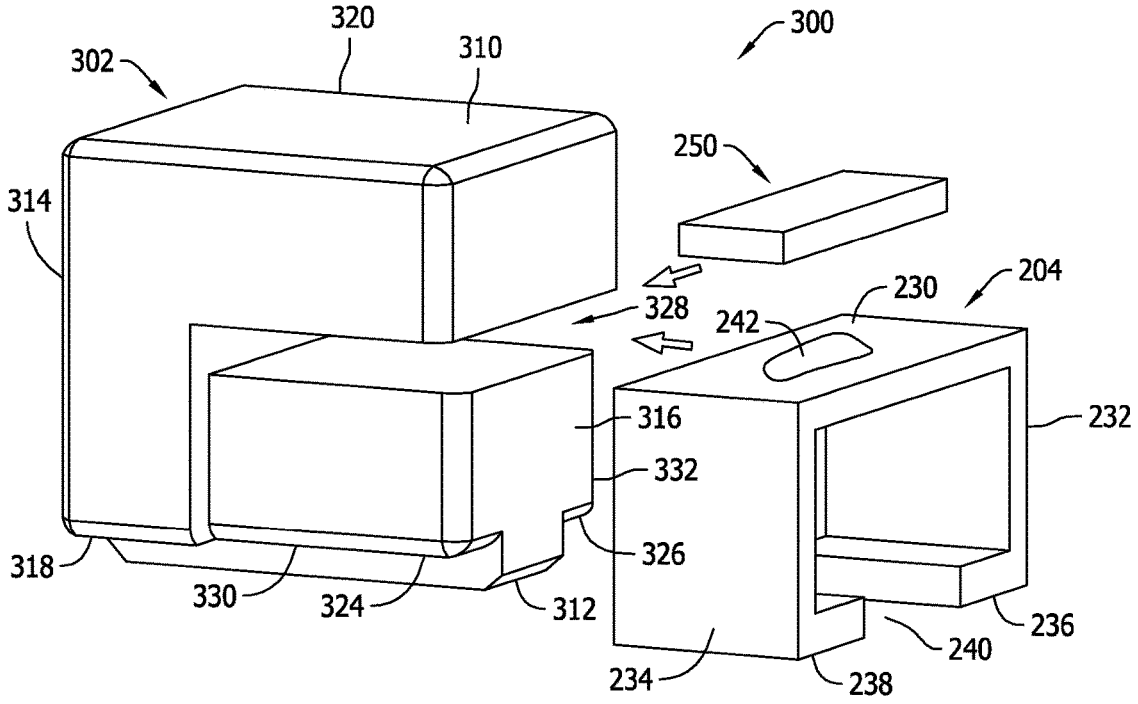
FIG. 7 is an assembly view of a third exemplary embodiment of a surface mount magnetic component.

As seen in FIG. 7, the component 300 includes a single piece, preformed magnetic core 302, the conductive winding 204, and the magnetic material 250, separately provided from the core piece 202, that enhances magnetic performance in a similar manner to the component 200.

The single piece core 302 is specifically distinguished from a component construction having discrete, first and second shaped core pieces that are assembled to one another in the component fabrication. In other words, the component 300 has one core piece 302 rather than two core pieces as in some types of conventional component constructions.

The core piece 302, like the core piece 202 includes a generally rectangular body having orthogonal walls including opposing top and bottom side walls 310, 312, opposing lateral side walls 314, 316 interconnecting the top and bottom side walls 310, 312, and opposing longitudinal side walls 318, 320 interconnecting the top and bottom side walls 310, 312 and the lateral side walls 314, 316. The bottom side wall 312 is optionally formed with a projecting guide surface 322 extending longitudinally between the lateral side walls 314, 316 and recessed side wall edges 324, 326 extending on either side wall of the guide surface 322.

Unlike the core piece 202 wherein the side walls 210, 214, 216, 218 and 220 are generally flat and planar, the side walls 318 and 320 include inset surfaces 330, 332 such that when the winding 204 is assembled to the core piece 302, the exterior surfaces of the terminal sections 232, 234 are substantially flush with the exterior, non-recessed surfaces of the side walls 318 and 320.

The magnetic core piece 302 is further formed with a physical gap 328 that extends to and through the lateral side wall 316 and to and through portions of the longitudinal side walls 318, 320. As such, the gap 328 is open at the core side wall 316 and also is open at portions of the core side walls 318, 320. The gap 328 extends generally parallel to the flat and planar top side wall 310, but is spaced from the top side wall 310. In the example shown, the gap 328 extends generally centrally in the core piece 302 and is about equidistant from the top and bottom side walls 310, 312. The gap 328 does not extend, however, to the lateral side wall 314. In other words, the gap 328 extends only partially between the side walls 314 and 316. Rather, the lateral side wall 314 is solid and has no openings formed therein. The gap 328 is also formed with a constant thickness t (FIG. 9) measured in a direction perpendicular to the plane of the top side wall 310 and parallel to the plane of the side walls 314, 316, 318 and 320. While a single (i.e., one and only one) gap 228 is shown, two or more gaps may be formed in the core piece if desired.

The core piece 302, except for the inset surfaces noted, may be fabricated from the same materials and processes discussed above in relation to the core piece 202. The gap 328 may likewise be formed in the core 302 in a substantially similar manner to the gap 228 in the core piece 202 described above.

The fabrication of the core 302 is an initial step of a method of manufacturing the component 300. The formulation of the magnetic material 250, using any of the techniques described above, and the initial configuration of the winding 204 (either preformed or non-preformed) also represent preparatory method steps so that the component parts and materials may be presented for assembly into the component 300 as discussed below.

Figure 8:
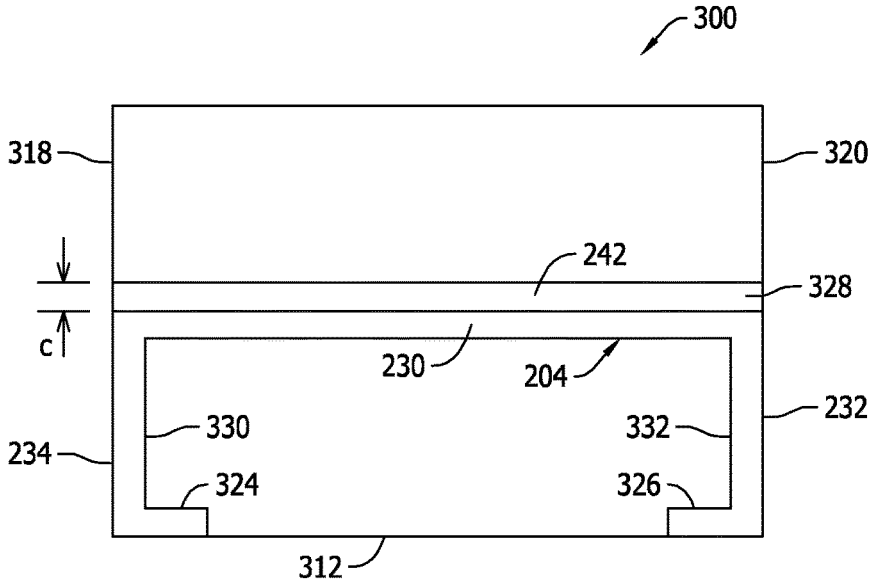
FIG. 8 is a side elevational view of the surface mount magnetic component shown in FIG. 7 at a first stage of manufacture.
Figure 9:
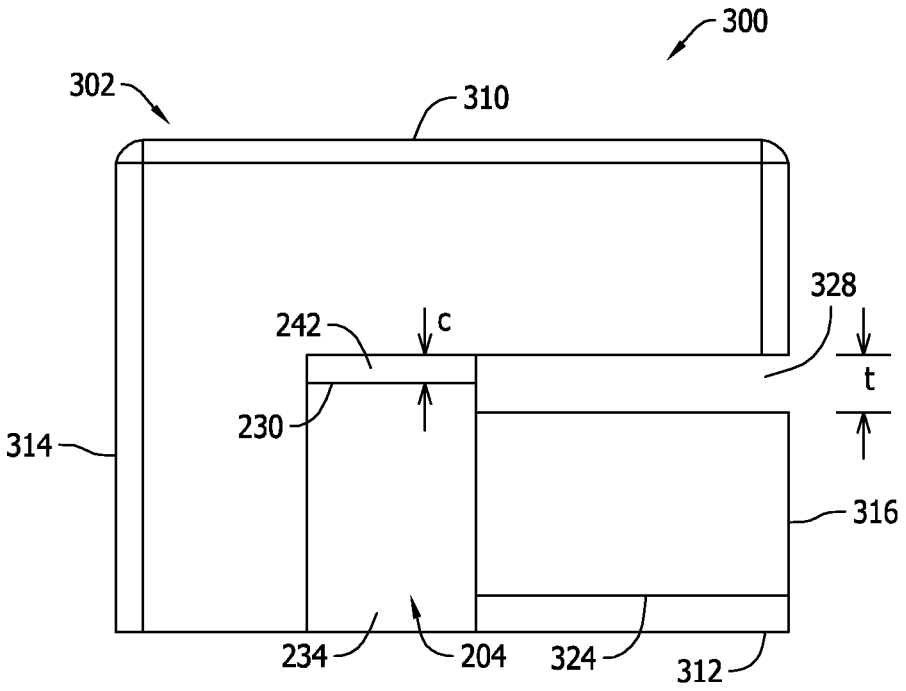
FIG. 9 is an end elevational view of the surface mount magnetic component shown in FIG. 7 at the first stage of manufacture.

FIGS. 8 and 9 illustrate a first manufacturing stage and further method steps of manufacturing the component 300. A bonding agent 242 (FIG. 7) is dispensed in the gap 328 and on the winding 204 as discussed above in relation to the component 200. The winding 204 is then assembled to the core piece 302 with the main winding section 230 extending in the gap 228 and, in the case of a preformed winding, the other sections 232, 234, 236, 238 extending around the external surfaces of the magnetic core piece 302 below the gap 328. In the case of a non-preformed winding, the projecting ends of the winding are bent around the external surfaces of the magnetic core piece 302 below the gap 328 into the shape shown. Either way, and in accordance with the components 100 and 200, a portion of the winding 204 (e.g., the sections 232, 234, 236, 238 of the winding 204) are exposed on the exterior of the core piece on the respective side walls and bottom side wall.

A space or clearance c (FIGS. 8 and 9) that would otherwise exist between the main winding section 230 and the core 202 is filled with the bonding agent 242 previously dispensed as the winding 204 is inserted and assembled to the core piece 302, without the bonding agent leaking to the exterior of the gap 328. Any of the bonding agents and techniques described above may be utilized.

Figure 10:
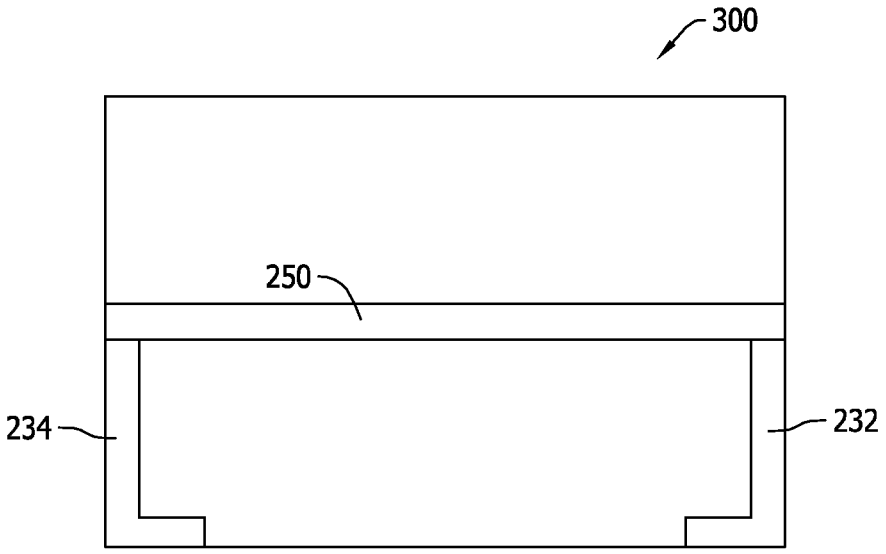
FIG. 10 is a side elevational view of the surface mount magnetic component shown in FIG. 7 at a second stage of manufacture.
Figure 11:
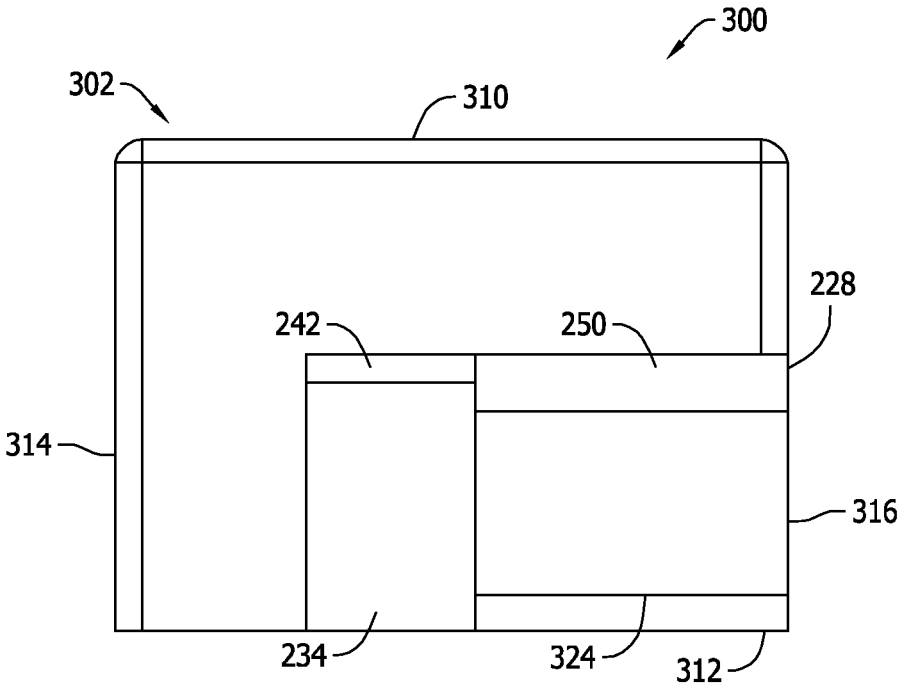
FIG. 11 is an end elevational view of the surface mount magnetic component shown in FIG. 7 at the second stage of manufacture.

FIGS. 10 and 11 illustrate a second manufacturing stage and further method steps of manufacturing the component 300. The magnetic material 250 is inserted in the gap 328. When the material is prefabricated as a magnetic strip, the dispensed boding agent rises via capillary action to the sides and surfaces of the magnetic strip 250. Other applications of the magnetic material described above to fill the gaps may likewise be utilized in lieu of magnetic strips.

Once the magnetic material 250 is applied to the gap 228, the component assembly may be cured as a final manufacturing step. Cross linking of the bonding agent(s) in the assembly secures the winding 204, the material 250 and the core piece 302 to one another. None of the winding 204, the material 250 or the core piece 302 are able to move relative to one another. Thus, even if the components 300 are subjected to vibration in use, their magnetic performance will remain steady and reliable.

Figure 12:
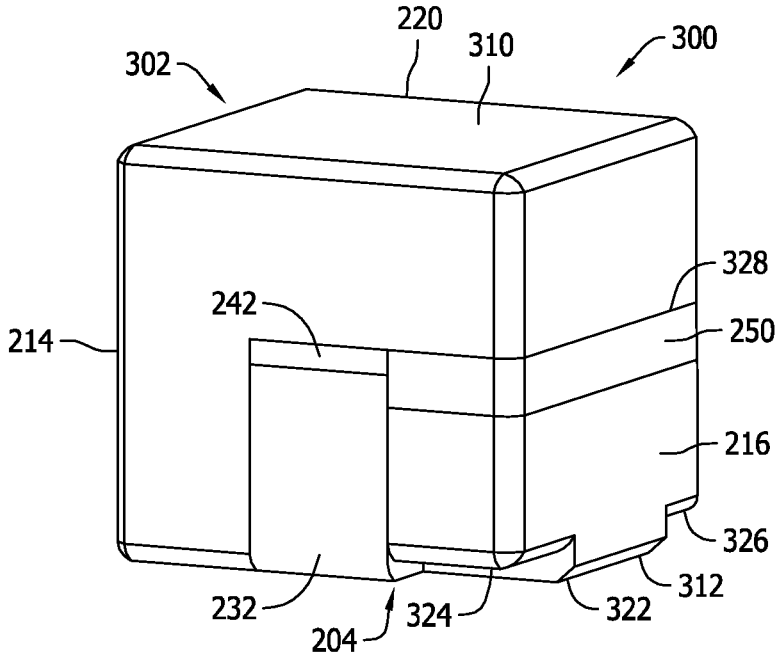
FIG. 12 is a perspective view of the completed component shown in FIG. 7.

FIG. 12 illustrates the component 300 when fully cured and complete. The bonding agent 242 and the magnetic strip 250 fill and seal the gap 228.

The component 300 offers similar benefits to the component 200. Any of the variations discussed above in relation to the component 200 also may apply to the component 300. The method steps described above may be repeated in embodiments where more than one winding is involved and/or embodiments where more than one gap is to be filled.

The components 100, 200, 300 define power inductors in contemplated embodiments. The power inductors 100, 200, 300 may be used in single phase, two phase, three phase and other multi-phase power management applications. When the components are mounted to a circuit board using the surface mount terminations of the windings described, the components 100, 200, 300 are operable with reduced fringing losses in comparison to conventional power inductor devices having a non-magnetic air gap.

The benefits of the inventive concepts disclosed are now believed to have been amply illustrated in view of the exemplary embodiments disclosed.

An embodiment of a surface mount magnetic component assembly has been disclosed including: a magnetic core fabricated from a first magnetic material, the magnetic core having at least one physical gap formed therein; a conductive winding extending through the at least one physical gap; and a second magnetic material, separately provided from the magnetic core, filling the physical gap; wherein the second magnetic material is a distributed gap material; and wherein at least a portion of the conductive winding is exposed on an exterior of the magnetic core.

Optionally, the first magnetic material may include a ferrite material. The second magnetic material may be a non-ferrite material. The second magnetic material may include metallic or alloy particles mixed with a polymer.

The magnetic core may include a single core piece. The single core piece may include opposed top and bottom side walls and opposing lateral side walls, and the physical gap may extend partially between the opposing lateral side walls. The magnetic core piece may further include opposing longitudinal side walls, and the physical gap may extend to the longitudinal side walls. The physical gap may extend parallel to the top side wall. A portion of the single core piece extending below the physical gap may have a T-shaped cross section.

The second magnetic material may be a prefabricated magnetic strip of material that is inserted into the physical gap. The prefabricated strip of magnetic material may include a rubbery material. The prefabricated strip of magnetic material may be compression molded.

The conductive winding may be preformed and separately provided from the magnetic core. The conductive winding may include a main winding section, terminal sections extending perpendicularly to the main winding section, and surface mount terminal sections extending perpendicularly to the main winding section. The gap may have a thickness, with the gap thickness being greater than a thickness of the main winding section, whereby the main winding section can be slidably inserted into the gap.

The surface mount magnetic component may further include a bonding agent and a prefabricated strip of magnetic material, with the bonding agent and the prefabricated strip of magnetic material filling and sealing the physical gap.

The assembly may define a power inductor. The second magnetic material may include a prefabricated disc that is inserted into the gap. The prefabricated disk may be fired at elevated temperatures to provide a high density insert material.

An embodiment of a surface mount magnetic component assembly has also been disclosed including: a single, shaped magnetic core piece fabricated from ferrite and having an integrally formed physical gap in a portion thereof; a conductive winding comprising a main winding section extending through the physical gap and terminal portions exposed on the exterior of the single, shaped magnetic core piece; a bonding agent securing the main winding section to the core piece; and a second magnetic material filling a remainder of the physical gap, the second magnetic material being a distributed gap material separately provided from single, shaped magnetic core piece.

Optionally, the second material may be a prefabricated magnetic strip inserted into a portion of the physical gap. The single magnetic core piece may have a T-shape. The conductive winding may be preformed from the single, shaped magnetic core piece. The assembly may define a power inductor. The bonding agent may include magnetic particles.

An embodiment of a surface mount magnetic component assembly has also been disclosed including: a single, shaped magnetic core piece fabricated from a first magnetic material, the single, shaped magnetic core piece formed with opposing lateral side walls and having a physical gap opening to one of the opposing lateral side walls; a preformed conductive winding comprising a main winding section extending through a portion of the physical gap and opposed terminal sections extending perpendicular to the main winding section, the opposed terminal sections extending substantially flush with the opposing lateral side walls of the single, shaped magnetic core piece core piece; a bonding agent filling a first portion of the physical gap and securing the preformed conductive winding to the single, shaped magnetic core piece; and a second magnetic material inserted into a second portion of the physical gap, the second magnetic material comprising a prefabricated magnetic strip including a distributed gap material, wherein the bonding agent also secures the prefabricated strip to the single, shaped magnetic core piece; wherein the assembly defines a power inductor. Optionally, the bonding agent may include magnetic particles.

An embodiment of a surface mount magnetic component assembly has also been disclosed including: a single, shaped magnetic core piece fabricated from a first magnetic material, the magnetic core having opposed top and bottom side walls and at least one non-magnetic gap formed therein and extending between and parallel to the opposed top and bottom side walls; a conductive winding extending through a portion of the at least one non-magnetic gap; and a strip of magnetic sheet material, fabricated separately from the magnetic core, inserted into the at least one non-magnetic gap.

Optionally, the strip of magnetic sheet material may include a rubbery material. The strip of magnetic sheet material may be compression molded.

The surface mount magnetic component may further include a bonding agent securing the conductive winding and the strip of magnetic sheet material to the single, shaped magnetic core piece. The bonding agent may be an epoxy. The bonding agent may also include magnetic particles.

At least a portion of the single, shaped magnetic core piece may have a T-shaped cross section. The conductive winding may be preformed from the single, shaped magnetic core piece. The winding may include a main winding section extending through a portion of the physical gap, opposed terminal sections extending perpendicular to the main winding section, and surface mount terminal sections extending parallel to the main winding section. The non-magnetic gap may have a thickness, with the gap thickness being greater than a thickness of the main winding section, whereby the main winding section can be slidably inserted into the non-magnetic gap. The opposed terminal sections may extend substantially flush with portions of the opposing lateral side walls of the single, shaped magnetic core piece core piece.

The assembly may define a power inductor. The magnetic core may include opposing lateral side walls, and wherein the non-magnetic gap extends partially between the opposing lateral side walls. The magnetic core may also include opposing longitudinal side walls, and wherein the non-magnetic gap extends to the longitudinal side walls. The second magnetic material may have different magnetic properties than the first magnetic material. The first magnetic material may include ferrite. The bottom side wall may include a projecting guide surface.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A surface mount magnetic component assembly comprising:

only one magnetic core piece fabricated from a first magnetic material and including opposed top and bottom side walls, opposed longitudinal side walls interconnecting the top and bottom side walls, opposed lateral side walls interconnecting the top and bottom side wall and the opposed longitudinal side walls, and a physical gap extending in spaced relation from the bottom side wall;

a conductive winding including a main winding section extending across a first portion of the physical gap, the conductive winding further including integrally formed and opposed first and second planar terminal sections extending in a spaced apart and parallel relationship to one another, the first and second planar terminal sections being exposed on the respective opposed longitudinal walls; and a second magnetic material adjacent the main winding section in at least a second portion of the physical gap, wherein the second magnetic material is a distributed gap material.

2. The surface mount magnetic component assembly of claim 1, wherein the first magnetic material comprises a ferrite material.

3. The surface mount magnetic component assembly of claim 1, wherein the second magnetic material comprises a non-ferrite material.

4. The surface mount magnetic component assembly of claim 1, wherein the second magnetic material comprises metallic or alloy particles mixed with a polymer.

5. The surface mount magnetic component assembly of claim 1, wherein the main winding section includes opposed first and second side edges and opposed first and second ends, and wherein the first and second side edges are each located within the physical gap.

6. The surface mount magnetic component assembly of claim 1, wherein the physical gap extends only partially between the opposed lateral side walls.

7. The surface mount magnetic component assembly of claim 6, wherein the physical gap extends to each of the opposed longitudinal side walls.

8. The surface mount magnetic component assembly of claim 6, wherein the physical gap extends parallel to the top side wall.

9. The surface mount magnetic component assembly of claim 6, wherein a portion of the only one magnetic core piece extending below the physical gap has a T-shaped cross section.

10. The surface mount magnetic component assembly of claim 1, wherein the second magnetic material comprises a prefabricated magnetic strip of material.

11. The surface mount magnetic component assembly of claim 10, wherein the prefabricated strip of magnetic material includes a rubbery material.

12. The surface mount magnetic component assembly of claim 10, wherein the prefabricated strip of magnetic material comprises a compression molded strip of magnetic material.

13. The surface mount magnetic component assembly of claim 1, wherein the conductive winding is preformed and separately provided from the only one magnetic core piece.

14. The surface mount magnetic component assembly of claim 1, wherein the main winding section extends as a strip in a first plane, the first and second planar terminal sections extending perpendicularly to the first plane from respective ends of the main winding section, and the conductive winding further comprising surface mount terminal sections extending parallel to the first plane.

15. The surface mount magnetic component assembly of claim 14, wherein the physical gap has a first thickness, the first thickness being greater than a second thickness of the main winding section.

16. The surface mount magnetic component assembly of claim 15 wherein the second magnetic material is a prefabricated strip of magnetic material extending in the second portion of the physical gap, the surface mount magnetic component further comprising a bonding agent securing the prefabricated strip of magnetic material in the second portion of the physical gap.

17. The surface mount magnetic component assembly of claim 1, wherein the surface mount magnetic component assembly defines a power inductor.

18. The surface mount magnetic component assembly of claim 1, wherein the second magnetic material comprises a prefabricated disc.

19. The surface mount magnetic component assembly of claim 18, wherein the prefabricated disc is fired at elevated temperatures to provide a high density insert material.

20. A surface mount magnetic component assembly comprising:

a magnetic core defined by only one magnetic core piece fabricated from ferrite and including opposed top and bottom side walls, opposed longitudinal side walls interconnecting the top and bottom side walls, opposed lateral side walls interconnecting the top and bottom side wall and the opposed longitudinal side walls, and an integrally formed physical gap extending to at least three of the opposed longitudinal side walls and the opposed lateral side walls;

a conductive winding comprising a substantially straight and planar main winding section extending in a portion of the physical gap and opposed terminal portions respectively exposed on an exterior of the only one magnetic core piece;

a bonding agent securing the planar main winding section to the only one magnetic core piece; and a distributed gap magnetic material filling a remainder of the physical gap.

21. The surface mount magnetic component assembly of claim 20, wherein the distributed gap material is a prefabricated magnetic strip extending adjacent the main winding section.

22. The surface mount magnetic component assembly of claim 20 wherein the only one magnetic core piece includes a T-shaped section extending on one side of the integrally formed physical gap.

23. The surface mount magnetic component assembly of claim 20, wherein the conductive winding is a preformed winding including flat surface mount terminals extending parallel to the main winding section.

24. The surface mount magnetic component assembly of claim 20, wherein the surface mount magnetic component assembly defines a power inductor.

25. The surface mount magnetic component assembly of claim 20, wherein the bonding agent includes magnetic particles.

26. A surface mount magnetic component assembly comprising:

a magnetic core defined by only one magnetic core piece fabricated from a first magnetic material;

wherein the only one magnetic core piece includes opposing top and bottom side walls, opposing longitudinal side walls interconnecting the top and bottom side walls, opposing lateral side walls interconnecting the top and bottom side wall and the opposing longitudinal side walls, and a physical gap opening spaced from the bottom wall and extending to only one of the opposing lateral side walls;

a preformed conductive winding comprising a planar main winding section extending straight through a first portion of the physical gap and opposed terminal sections extending perpendicular to the main winding section, the opposed terminal sections extending substantially flush with the opposing longitudinal side walls;

a bonding agent filling a second portion of the physical gap and securing the planar main winding section of the preformed conductive winding to the only one magnetic core piece; and a second magnetic material extending in a third portion of the physical gap adjacent the planar main winding section, the second magnetic material comprising a prefabricated magnetic strip including a distributed gap material, wherein the bonding agent also secures the prefabricated strip to the only one magnetic core piece;

wherein the assembly defines a power inductor.

27. The surface mount magnetic component assembly of claim 26, wherein the bonding agent includes magnetic particles.

28. A surface mount magnetic component assembly comprising:

a magnetic core defined by only one magnetic core piece fabricated from a first magnetic material, the only one magnetic core piece having opposed and generally parallel top and bottom side walls and at least one gap formed therein, the gap extending in a spaced location from but generally parallel to the opposed top and bottom side walls;

a conductive winding including a planar main winding section extending fully in a portion of the gap; and a strip of magnetic sheet material extending in the gap adjacent the planar main winding section.

29. The surface mount magnetic component of claim 28, wherein the strip of magnetic sheet material includes a rubbery material.

30. The surface mount magnetic component of claim 28, wherein the strip of magnetic sheet material is a compression molded strip of magnetic sheet material.

31. The surface mount magnetic component of claim 28, further comprising a bonding agent securing the conductive winding and the strip of magnetic sheet material to the only one magnetic core piece.

32. The surface mount magnetic component of claim 31, wherein the bonding agent is an epoxy.

33. The surface mount magnetic component of claim 31, wherein the bonding agent includes magnetic particles.

34. The surface mount magnetic component assembly of claim 28, wherein at least a portion of the only one magnetic core piece has a T-shaped cross section.

35. The surface mount magnetic component assembly of claim 28, wherein the conductive winding is a preformed strip of conductive material.

36. The surface mount magnetic component assembly of claim 28, wherein the conductive winding further includes opposed terminal sections extending perpendicular to the main winding section, and surface mount terminal sections extending parallel to the main winding section.

37. The surface mount magnetic component assembly of claim 36, wherein the gap has a first thickness, the first thickness being greater than a second thickness of the planar main winding section.

38. The surface mount magnetic component assembly of claim 36, wherein the only one magnetic core piece further has opposing lateral side walls interconnecting the opposed top and bottom side walls, and wherein the opposed terminal sections extend substantially flush with portions of the opposing lateral side walls of the only one magnetic core piece.

39. The surface mount magnetic component assembly of claim 28, wherein the surface mount magnetic component assembly defines a power inductor.

40. The surface mount magnetic component assembly of claim 28, wherein the only one magnetic core piece includes opposing lateral side walls, and wherein the gap extends only partially between the opposing lateral side walls.

41. The surface mount magnetic component assembly of claim 28, wherein the only one magnetic core piece further includes opposing longitudinal side walls, and wherein the gap extends to each of the opposing longitudinal side walls.

42. The surface mount magnetic component assembly of claim 28, wherein the strip of magnetic sheet material has different magnetic properties than the first magnetic material.

43. The surface mount magnetic component assembly of claim 28, wherein the first magnetic material comprises ferrite.

44. The surface mount magnetic component assembly of claim 28, wherein the bottom side wall includes a projecting guide surface.

* * * * *